United States Patent [19]

Rubin

[11] Patent Number: 4,505,476

[45] Date of Patent: Mar. 19, 1985

[54] PORTABLE EXERCISER

[76] Inventor: Ben Rubin, 37 S. Iowa Ave. #6B, Atlantic City, N.J. 08401

[21] Appl. No.: 412,554

[22] Filed: Aug. 30, 1982

[51] Int. Cl.[3] ..... A63B 23/04

[52] U.S. Cl. ..... 272/146; 272/DIG. 4; 272/DIG. 9

[58] Field of Search ..... 272/69, 70, 146, 46, 272/96, 97, DIG. 9, DIG. 4; 128/25 R, 25 B

[56] References Cited

U.S. PATENT DOCUMENTS

| | | | |
|---|---|---|---|
| 2,573,808 | 11/1951 | Ravoire | 272/97 |
| 2,827,894 | 3/1958 | Meyers | 128/25 B |
| 3,372,930 | 3/1968 | Sertich | 272/96 X |
| 3,784,193 | 1/1974 | Simjian | 272/146 X |
| 3,936,047 | 2/1976 | Brandt et al. | 272/146 |
| 4,200,282 | 4/1980 | Agyagos | 272/146 |
| 4,252,312 | 2/1981 | Dehan | 272/97 |

FOREIGN PATENT DOCUMENTS

| | | | |
|---|---|---|---|
| 840299 | 4/1970 | Canada | 272/146 |
| 2012727 | 10/1971 | Fed. Rep. of Germany | 272/146 |
| 2641610 | 11/1977 | Fed. Rep. of Germany | 272/97 |
| 557226 | 5/1924 | France | 272/146 |
| 425573 | 5/1967 | Switzerland | 272/146 |
| 1276509 | 6/1972 | United Kingdom | 272/69 |

*Primary Examiner*—Robert A. Hafer
*Assistant Examiner*—Arnold W. Kramer
*Attorney, Agent, or Firm*—Thomas R. Morrison

[57] ABSTRACT

A portable exerciser includes a rotatable platform on which a person desiring exercise can walk or run and adjustable height handholds which the person exercising can grasp to maintain balance. Auxiliary legs are provided permitting the surface of the exerciser to be tilted in simulation of a hill and an adjustable brake controls the amount of resistance to motion for varying the exercise content of the activity. The walking or running surface may be folded or rotated into alignment with the posts supporting the handholds for compactness of storage and transportation.

2 Claims, 2 Drawing Figures

PORTABLE EXERCISER

BACKGROUND OF THE INVENTION

The present invention relates to exercise devices and, more particularly, to devices which permit walking or jogging in a limited space.

Walking and running devices have been employed using, for example, the treadmill principle in which a belt loop is disposed over rollers and a person is permitted to walk or run on the upper surface of the belt which may be either passive or driven.

A running device is shown in U.S. Pat. No. 1,521,946 in which a circular disc is supported in a level position on rollers permitting walking or running on the surface thereof for exercise.

A child's merry-go-round, disposed in U.S. Pat. No. 2,785,896, similarly disposes a circular platform in a horizontal location on rollers for children's play.

U.S. Pat. No. 3,384,369 discloses a circular platform on rollers with a pipe framework above it for permitting exercise thereon.

The above-mentioned devices are relatively large, heavy and provide no provision for either tilting the walking or running surface or for compact stowage.

OBJECTS AND SUMMARY OF THE INVENTION

Accordingly, it is an object of the invention to provide an exercise device which overcomes the drawbacks of the prior art.

It is a further object of the invention to provide an exercise device with a rotating table which can be tilted to simulate hills.

It is a further object of the invention to provide a rotatable exercise device with means for varying the resistance to motion.

It is a further object of the invention to provide a rotatable-type exerciser which can be compactly folded for storage or transportation.

According to an aspect of the present invention, there is provided an exercise device, comprising a rotatable disc adapted for supporting feet of an individual and being rotatable about an axis, a hand grip rod supported above the disc for grasping by the individual, and means for adjusting a tilt of the disc whereby hills are simulated.

DETAILED DESCRIPTION OF THE PREFERRED EMBODIMENT

Figure 1:
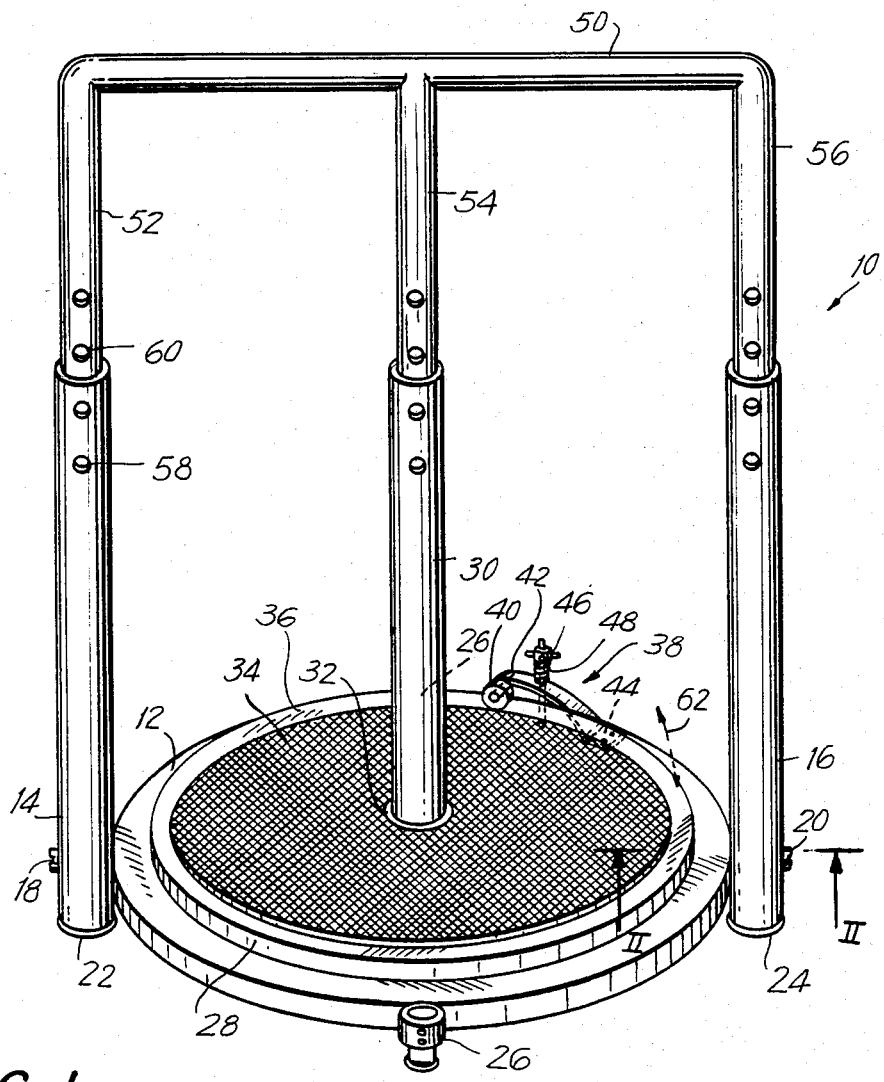
FIG. 1 is a perspective view of a portable exerciser according to an embodiment of the invention.

Referring now to FIG. 1, there is shown, generally at 10 an exerciser according to an embodiment of the invention. A platform 12 is supported at opposed edges by side posts 14 and 16 which are respectively hingeably attached to platform 12 by convenient means such as by bolts 18 and 20. Bottom ends of side posts 14 and 16 optionally may contain cushioning plugs 22 and 24 for protection of a surface upon which exerciser 10 may rest. A pair of adjustable height auxiliary legs 26 are disposed at ninety degrees from side posts 14 and 16 (one of auxiliary legs 26 is hidden by other apparatus).

A rotatable disc 28 is centrally disposed on platform 12 and may optionally have a center post 30 passing through an opening 32 in the center thereof. A non-skid surface 34 is optionally provided on the upper surface of rotatable disc 28 to withstand wear of feet and to provide a skid-resistant surface. Non-skid surface 34 may be of any convenient material such as rubber or bonded granular material, etc.

An annular outer edge 36 of the upper surface of rotatable disc 28 does not include non-skid surface 34.

An adjustable friction device shown generally at 38, permits adjusting the resistance to rotation of rotatable disc 28. Adjustable resistance device 38 includes a roller 40 on arm 42. The distal end of arm 42 is hingeably affixed to platform 12 by any convenient means such as, for example, by a hinge 44.

A tensioning device includes a screw threaded into platform 12 turnable by a handle 46. Resilient means such as a coil spring 48 biased between handle 46 and arm 42 applies downward force on roller 40 in proportion to the tightness of adjustment of the screw. Roller 40 is preferably of resilient material such as, for example, synthetic rubber which may be deformed at the contact surface with outer edge 36 to vary the rolling resistance of roller 40 and thus to proportionately resist rotation of rotatable disc 28.

A hand-grip rod 50 spans the distance between side posts 14 and 16 and includes downard depending post support rods 52, 54 and 56 respectively fittable into open ends of side post 14, center post 30 and side post 16. A plurality of spaced apart holes 58 in the posts are alignable with corresponding holes 60 in the post support rods. By inserting a pin through mating ones of holes 58 and 60, hand-grip rod 50 can be positioned at any convenient height for the user.

Auxiliary legs 26 can similarly have their height changed. When the rear auxiliary leg 26 (hidden) is lengthened and the front auxiliary leg 26 is shortened, platform 12 is tilted about an axis defined by bolts 18 and 20 as indicated by an arrow 62. By variably tilting platform 12 and rotatable disc 28 and varying the resistance to rotation by adjustment of adjustable friction device 38, any selected condition of hill, etc., can be simulated.

In order to fold exerciser 10 for storage or transporation, hand-grip rod 50 and post support rods 52, 54 and 56 may be removed, center post 30 may be pulled out of opening 32 and platform 12 with rotatable disc 28 affixed therein may be rotated about bolts 18 and 20 until they are parallel to side posts 14 and 16. Auxiliary legs 26 may also be foldable parallel to platform 12. When thus folded, the assembly is a relatively flat and compact package.

Although platform 12 is illustrated as having a circular outer perimeter, platform 12 may have other shapes such as, for example, a square or rectangle. Posts 14, 16 and 30 as well as hand-grip rod 50 and post support rods 52, 54 and 56 may be of any convenient material such as, for example, metal, plastic or composite selected for durability, light weight and cost.

Figure 2:
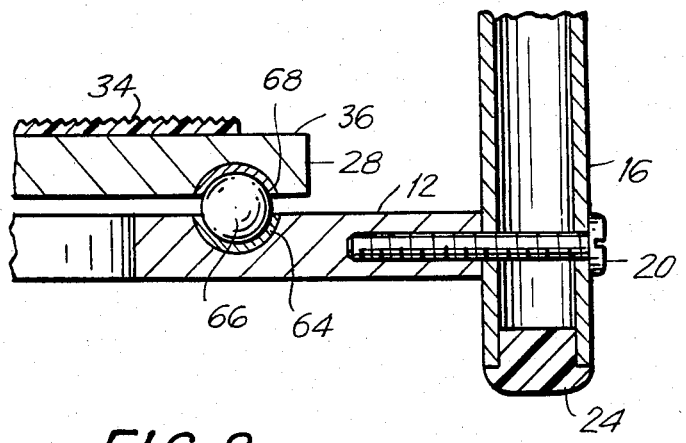
FIG. 2 is a cross section taken along II-II of FIG. 1.

Referring now to FIG. 2, platform 12 is seen to be an annular rim having a ball bearing race 64 therein supporting a plurality of ball bearings 66. Similarly, rotatable disc 28 includes a mating ball bearing race 68. In one embodiment, ball bearing races 64 and 68 are filled with ball bearings 66. In another embodiment, a smaller number of ball bearings 66 are disposed separate from each other in a cage (not shown).

Instead of using ball bearing races 64 and 68 to contain ball bearings 66, a plurality of rollers or other rotatable supporting devices may be employed to support rotatable disc 28 in relation to platform 12.

Although rotatable disc 28 and platform 12 are shown made of wood, this should not be considered limiting since other suitable materials such as, for example, metal or plastic may be employed.

In addition, it would be recognized that center post 30 may not be required in all cases. In addition, instead of platform 12 being an annular rim, it may alternatively be a full disc or rectangle.

Platform 12 may be dimensioned so that, when it is hinged parallel to side posts 14 and 16, it moves into abutment with center post support rod 54. A pin or other means may be employed to affix these parts together for storage or shipment.

It would also be clear to one skilled in the art that rotatable disc 28 may be rotated by a conventional motor drive (not shown) instead of purely manually by the user's feet.

I claim:

1. A portable exerciser comprising:

a platform;

a generally circular rotatable disc on said platform;

an opening centrally disposed in said rotatable disc;

a center post fittable into said opening;

first and second side posts at opposed edges of said platform;

first and second hingeable means for permitting rotation of said first and second side posts about an axis joining said first and second hingeable means;

said first and second side posts being extended downward past said platform and including means for supporting said platform above a surface;

at least one auxiliary leg on said platform angularly spaced from said first and second side posts and including means extending downward from said platform for supporting said platform above said surface;

said at least one auxiliary leg including means for permitting changing of a length thereof whereby said platform may be tilted about said axis;

a hand grip rod;

first, second and third post support rods affixed to said hand grip rod and engageable with said first and second side posts and said center post for support of said hand grip rod at a distance above said platform;

means in at least some of said first and second side posts, said center post and said first, second and third support rods for permitting adjustment of said distance;

an upper surface on said disc adapted for permitting running thereon; and means for permitting said disc to rotate with a predetermined resistance about said center post whereby a person may hold said hand grip rod and run on said upper surface for obtaining exercise therefrom.

2. A portable exerciser according to claim 1, wherein said first and second hingeable means includes means for permitting said platform and said rotatable disc to be tilted parallel to said first and second side posts whereby said portable exerciser is made compact for storage and transportation.

* * * * *